US010480510B2

(12) United States Patent
Yano et al.

(10) Patent No.: US 10,480,510 B2
(45) Date of Patent: Nov. 19, 2019

(54) OIL-FREE SCREW COMPRESSOR AND DESIGN METHOD THEREFOR

(71) Applicant: Kobe Steel, Ltd., Hyogo (JP)

(72) Inventors: Yoshio Yano, Hyogo (JP); Toshiyuki Miyatake, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 287 days.

(21) Appl. No.: 15/513,841

(22) PCT Filed: Sep. 24, 2015

(86) PCT No.: PCT/JP2015/076915
§ 371 (c)(1),
(2) Date: Mar. 23, 2017

(87) PCT Pub. No.: WO2016/052296
PCT Pub. Date: Apr. 7, 2016

(65) Prior Publication Data

US 2017/0284392 A1 Oct. 5, 2017

(30) Foreign Application Priority Data

Sep. 29, 2014 (JP) ..... 2014-198958

(51) Int. Cl.
*F04C 27/02* (2006.01)
*F04C 18/16* (2006.01)
(Continued)

(52) U.S. Cl.
CPC ..... *F04C 18/16* (2013.01); *F04C 27/005* (2013.01); *F04C 29/00* (2013.01)

(58) Field of Classification Search
CPC ..... F04C 27/005; F04C 27/00; F04C 27/02; F04C 27/009; F04C 2240/30;
(Continued)

(56) References Cited

U.S. PATENT DOCUMENTS 6,402,266 B1 * 6/2002 Ariki ..... B60T 8/34 303/116.4
7,210,687 B2 * 5/2007 Takahashi ..... F16J 15/3404 277/348
(Continued)

FOREIGN PATENT DOCUMENTS

JP S60-32990 A 2/1985
JP H03-110138 U 11/1991
(Continued)

OTHER PUBLICATIONS

International Search Report issued in PCT/JP2015/076915; dated Dec. 28, 2015.
(Continued)

*Primary Examiner* — Deming Wan
(74) *Attorney, Agent, or Firm* — Studebaker & Brackett PC

(57) ABSTRACT

The oil-free screw compressor includes: a casing having a rotor chamber; a bearing supporting rotary shafts of screw rotors; a shaft seal device with an oil seal portion and an air seal portion; a ventilation gap positioned between the oil seal portion and the air seal portion; and an atmosphere open passage communicating an atmosphere side of the casing with the ventilation gap communicate. A most narrowed portion, an air seal portion, and oil seal portions are set such that the followings is established:

$$(La/Sa^{2.5})/(Lh/Sh^{2.5})>|P2|/\Delta Pb$$

La: effective shaft seal length
Sh: effective open cross-sectional area (most narrowed portion of atmosphere open passage)
Lh: effective narrowed length (most narrowed portion of atmosphere open passage)
Sa: shaft seal cross-sectional area
(Continued)

|P2|: negative pressure in rotor chamber during unloading operation

ΔPb: minimum differential pressure in the oil seal portion during the unloading operation.

8 Claims, 5 Drawing Sheets

(51) Int. Cl.
*F04B 39/00* (2006.01)
*F04C 29/00* (2006.01)
*F04C 27/00* (2006.01)

(58) Field of Classification Search
CPC ..... F04C 2240/50; F04C 2240/60; F04C 2220/12; F04C 18/16; F04C 29/00; F04B 39/00
See application file for complete search history.

(56) References Cited

U.S. PATENT DOCUMENTS

2008/0240964 A1 10/2008 Kimura et al.
2010/0253005 A1* 10/2010 Liarakos ..... F16J 15/164 277/353
2012/0051959 A1* 3/2012 Nakamura ..... F04C 15/0034 418/104
2013/0075975 A1* 3/2013 Hilaris ..... F04C 15/0003 277/350

FOREIGN PATENT DOCUMENTS

JP H7-317553 A 12/1995
JP 2008-255796 A 10/2008
JP 2011-256828 A 12/2011

OTHER PUBLICATIONS

Written Opinion issued in PCT/JP2015/076915; dated Dec. 28, 2015.
Notification of Transmittal of Translation of the International Preliminary Report on Patentability (Chapter I) and Translation of Written Opinion of the International Searching Authority; PCT/JP2015/076915; dated Apr. 13, 2017.

* cited by examiner $$Sh=\min(Sh_1, Sh_2=\sum_{i=1}^{n} Sh_{2i})$$

$La = La_1 + La_2$

OIL-FREE SCREW COMPRESSOR AND DESIGN METHOD THEREFOR

CROSS-REFERENCE TO RELATED APPLICATIONS

This is a national phase application in the United States of International Patent Application No. PCT/JP2015/076915 with an international filing date of Sep. 24, 2015, which claims priority of Japanese Patent Application No. 2014-198958 filed on Sep. 29, 2014 the contents of which are incorporated herein by reference.

TECHNICAL FIELD

The present invention relates to an oil-free screw compressor.

BACKGROUND ART

In the oil-free screw compressor, air is compressed by a pair of male and female screw rotors which is rotatable in an oil no-supply state and in a non-contact state. In the oil-free screw compressor, there may be a case where compressed air produced in a rotor chamber is leaked along a rotary shaft or a lubricant supplied to a gear which drives the rotary shaft or a bearing which supports the rotary shaft flows into the rotor chamber. To prevent such drawbacks, a shaft seal device is disposed between the rotor chamber and the bearing. The shaft seal device includes: an air seal portion which seals compressed air from the rotor chamber; and an oil seal portion which seals a lubricant from the bearing.

When the rotor chamber is brought into a negative pressure state during an unloading operation, there may be a case where a lubricant which is supplied to the bearing or the like flows into the inside of the rotor chamber after passing through the oil seal portion although an amount of the lubricant is insignificant. To prevent such flowing in of the lubricant into the inside of the rotor chamber, an atmosphere open passage is provided for making an air ventilation gap formed on a rotor-chamber-side end portion of the oil seal portion and an atmosphere side of a casing communicate with each other. When the rotor chamber is brought into a negative pressure state, atmospheric air is introduced into the ventilation gap through the atmosphere open passage thus preventing the lubricant from flowing into the rotor chamber.

The oil-free screw compressor provided with the above-mentioned shaft seal device is disclosed in JP 2011-256828 A and JP 2008-255796 A, for example.

SUMMARY OF THE INVENTION

Problems to be Solved by the Invention

In an oil-free screw compressor disclosed in JP 2011-256828 A, a seal box portion formed between an air seal and a visco-seal or a communication hole of a seal box communicates with an atmosphere open hole formed in a casing. With such a configuration, the flowing in of a lubricant into a rotor chamber is prevented. Further, in an oil-free rotary compressor disclosed in JP 2008-255796 A, a buffer space is formed so as to make an oil seal portion and an air seal portion spaced apart from each other. With such a configuration, a leaked lubricant is temporarily reserved in a buffer space and hence, the flowing in of the lubricant into a rotor chamber is prevented. That is, the above-mentioned two prior arts disclose a technique for preventing the flowing in of a lubricant into the rotor chamber through the atmosphere open passage formed from the atmosphere open hole, the communication hole or the like.

However, neither one of the above-mentioned prior arts discloses the configurations of a shaft seal device and the atmosphere open passage which allows the oil-free screw compressor to realize both the prevention of flowing in of a lubricant and a compression performance at the same time.

In the atmosphere open passage, there is almost no case where the atmosphere open passage has the same open cross-sectional area over the entire length thereof. That is, usually, the atmosphere open passage has a narrowed portion by narrowing a portion of the atmosphere open passage. There exists a drawback that the smaller the open cross-sectional area of the narrowed portion or the larger a length of the narrowed portion, the larger a pressure loss becomes so that an effect of preventing the flowing in of a lubricant is decreased.

On the other hand, on a safety side, it is desirable to increase the open cross-sectional area of the atmosphere open passage. When the open cross-sectional area of the atmosphere open passage is increased, a length of a rotary shaft in an axial direction is increased so that the rotary shaft is liable to be deflected. Due to the deflection of the rotary shaft, a shaft seal ability of the air seal portion and a shaft seal ability of the oil seal portion are lowered. Further, when the oil-free screw compressor is designed such that the contact between the members is prevented by taking the deflection of the rotary shaft into consideration, the oil-free screw compressor is configured such that a gap between female and male screw rotors or a gap between the screw rotor and a casing is increased. Such a configuration adversely affects a compression performance of the compressor. In this manner, in spite of the existence of such a trade-off relationship between the prevention of flowing in of a lubricant by the atmosphere open passage and the acquisition of reliable compressibility, no particular consideration has been taken conventionally with respect to this point.

Accordingly, it is an object of the present invention to provide an oil-free screw compressor and a method of designing such an oil-free screw compressor which can realize both the prevention of flowing in of a lubricant and the acquisition of reliable compressibility.

Means for Solving the Problems

To solve the above-mentioned technical problems, according to the present invention, an oil-free screw compressor having the following configurations is provided.

That is, in an oil-free screw compressor which includes: a pair of female and male screw rotors which meshes with each other in a non-contact manner; a casing having a rotor chamber in which the screw rotors are housed; a bearing which supports rotary shafts of the screw rotors; a shaft seal device which includes an oil seal portion disposed on a bearing side and an air seal portion disposed on a rotor chamber side and shaft-seals the rotary shaft; a ventilation gap which is positioned between the oil seal portion and the air seal portion and is formed between an outer peripheral surface of the rotary shaft and an inner peripheral surface of the shaft seal device; and an atmosphere open passage which makes an atmosphere side of the casing and the ventilation gap communicate with each other, wherein assuming an effective open cross-sectional area as Sh and an effective narrowed length as Lh in a most narrowed portion where the atmosphere open passage is most narrowed, and assuming a shaft seal cross-sectional area in a direction orthogonal to a rotary shaft as Sa and an effective shaft seal length as La in a fine gap in the air seal portion, assuming an absolute value of a negative pressure in the rotor chamber during an unloading operation as |P2|, and assuming a minimum differential pressure in the oil seal portion during the unloading operation as ΔPb, the most narrowed portion, the air seal portion and the oil seal portion are set such that a following relationship is established.

$$(La/Sa^{2.5})/(Lh/Sh^{2.5})>|P2|/\Delta Pb$$

As will be described in detail later, an approximation relating to a pressure loss in an air pipe is applied to the most narrowed portion and the air seal portion of the atmosphere open passage, and the oil-free screw compressor is configured such that the minimum differential pressure ΔPb in the oil seal portion becomes larger than the absolute value |P2| of a negative pressure in the ventilation gap. With such a configuration, air in the ventilation gap is intended to be pushed out toward the bearing and hence, the flowing in of a lubricant into the rotor chamber can be prevented. A compression performance can be reliably realized through the optimization of the atmosphere open passage. In this manner, according to the present invention, the oil-free screw compressor can realize both the prevention of flowing in of a lubricant and the acquisition of reliable compressibility.

MODE FOR CARRYING OUT THE INVENTION

Figure 1:
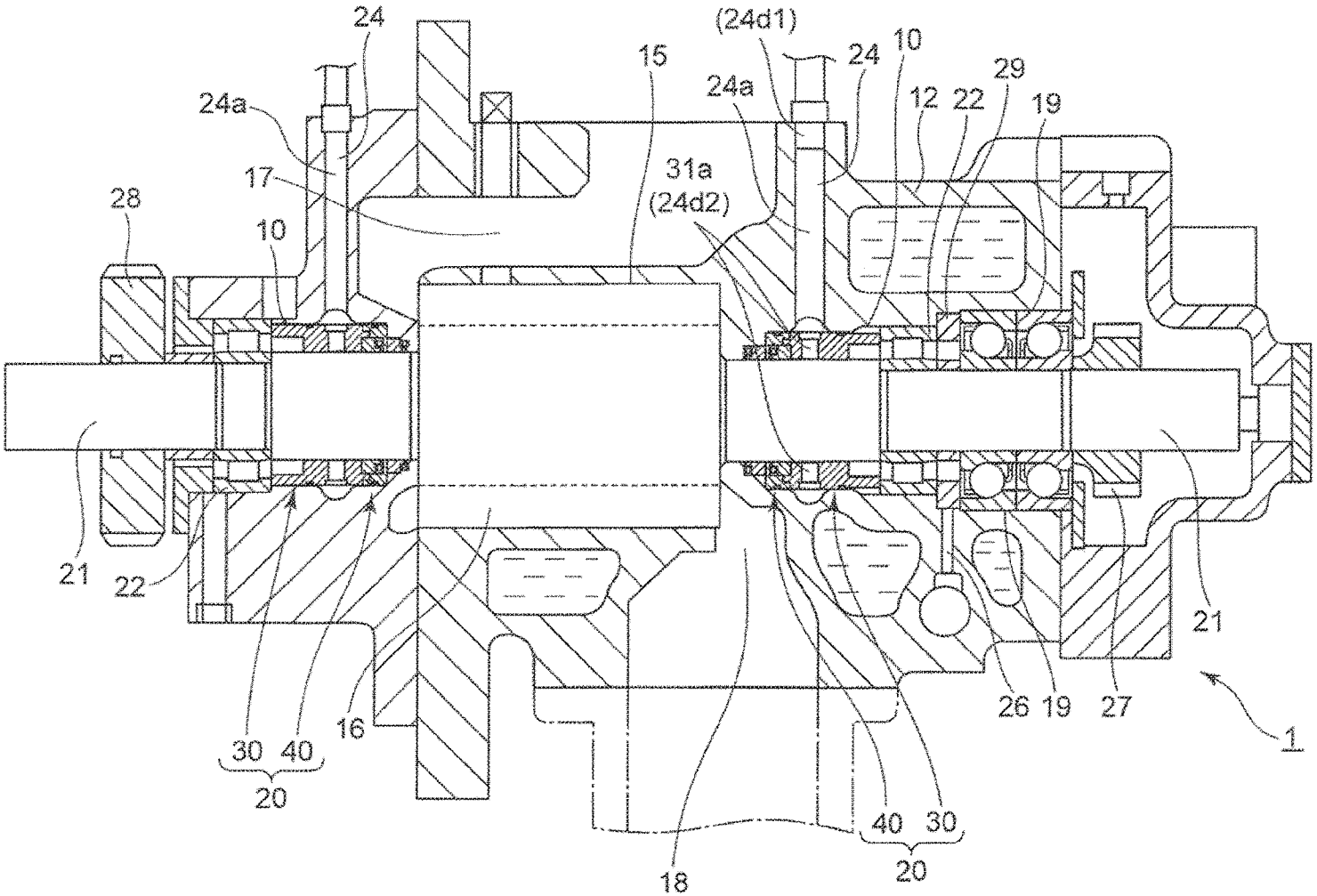
FIG. 1 is a longitudinal cross-sectional view showing the schematic configuration of an oil-free screw compressor according to the present invention.

First, the schematic configuration of an oil-free screw compressor 1 according to an embodiment of the present invention is described in detail with reference to FIG. 1.

In the oil-free screw compressor 1, a pair of male and female screw rotors 16 which meshes with each other is housed in a rotor chamber 15 formed in a casing 12. The casing 12 is, for example, formed of a casing body, a discharge-side casing portion, and a suction-side casing portion.

The casing 12 has: a suction port 17 through which air which is an object to be compressed is supplied to the rotor chamber 15; and a discharge port 18 through which compressed air compressed by the screw rotors 16 in the rotor chamber 15 is discharged. A rotary shaft 21 is formed on respective end portions of the screw rotor 16 on a discharge side and a suction side. A drive gear 28 and a timing gear 27, which separate from each other, are mounted on the respective end portions of the rotary shafts 21 on the discharge side and the suction side. A rotational drive force of a motor not shown in the drawing is transmitted to one screw rotor 16 by way of the drive gear 28. The rotational drive force transmitted to one screw rotor 16 is transmitted to the other screw rotor 16 by way of the timing gear 27. Due to the rotation of the pair of screw rotors 16 in a non-contact state and also in a state where the screw rotors 16 mesh with each other, air is sucked in through the suction port 17. Air sucked in through the suction port 17 is compressed to a predetermined pressure, and compressed air is discharged from the discharge port 18.

On a discharge side of the casing 12, a shaft seal device loading space 10 on a discharge side is formed. In the shaft seal device loading space 10 on a discharge side, ball bearings (angular ball bearings in two rows) 19 and a bearing (roller bearing) 22 which rotatably support the rotary shaft 21 on a discharge side and a shaft seal device 20 on a discharge side are loaded. Also on a suction side of the casing 12, a shaft seal device loading space 10 on a suction side is formed. In the shaft seal device loading space 10 on a suction side, a bearing (roller bearing) 22 which rotatably supports the rotary shaft 21 on a suction side and a shaft seal device 20 on a suction side are loaded.

An atmosphere open hole 24*a* which connects the outside (atmosphere side) and an inner peripheral side of the casing 12 and communicates with an atmosphere is formed in the casing 12. An oil supply hole 26 for supplying a lubricant to the bearings 19, 22 and the timing gear 27 is formed in the casing 12.

The shaft seal devices 20 loaded in the shaft seal device loading spaces 10 on a discharge side and a suction side are formed substantially in symmetry with respect to the rotor chamber 15. Hereinafter, the shaft seal device 20 on a discharge side and an area around the shaft seal device 20 are described in detail with reference to FIGS. 2 and 3.

Figure 2:
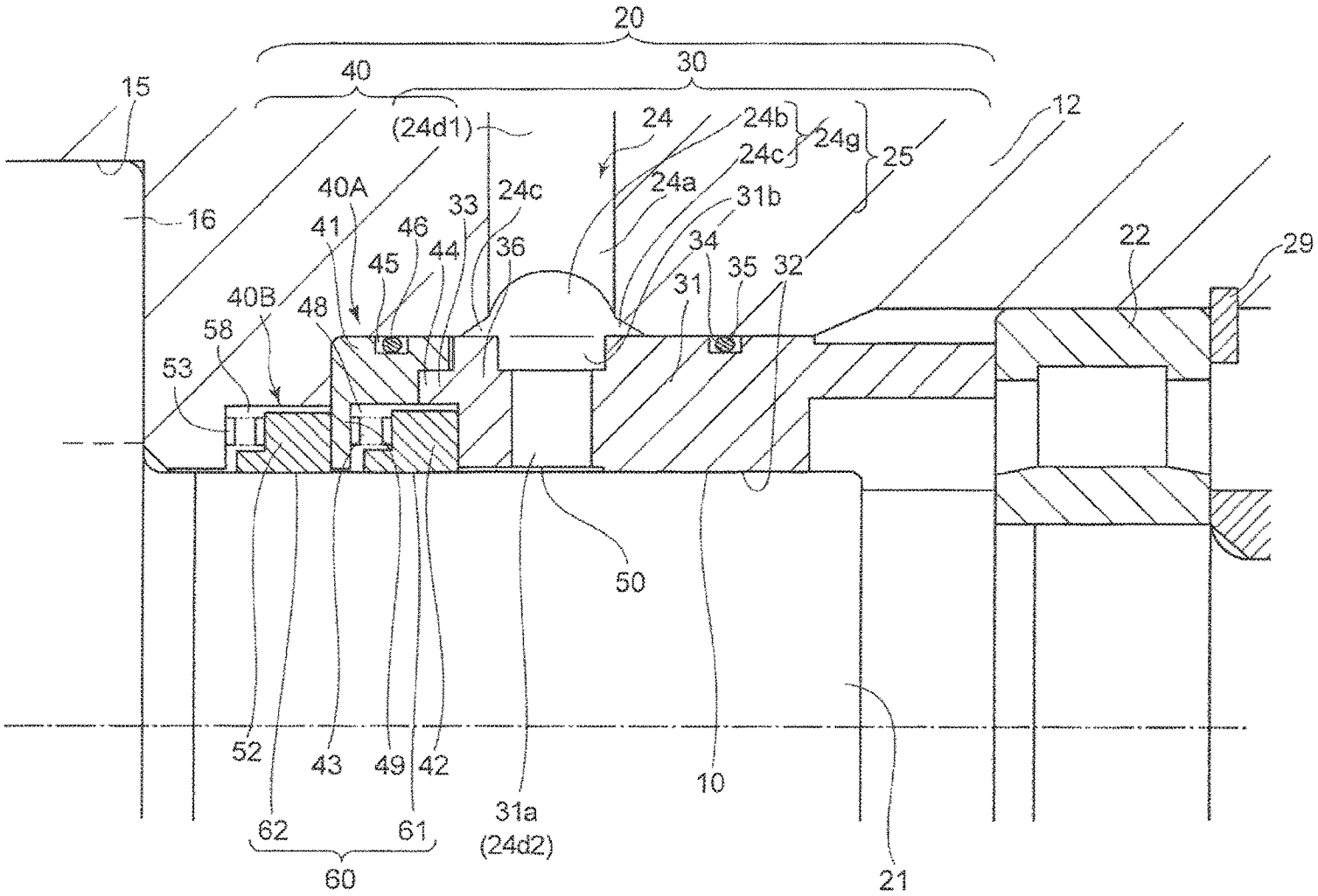
FIG. 2 is a partial cross-sectional view showing a shaft seal device and an area around the shaft seal device in the oil-free screw compressor shown in FIG. 1.

FIG. 2 is a partial cross-sectional view of the shaft seal device 20 on a discharge side and the area around the shaft seal device 20 in the oil-free screw compressor 1 shown in FIG. 1.

The bearing 22, a first shaft seal portion 30 which seals a lubricant, and a second shaft seal portion 40 which seals compressed air are loaded in the shaft seal device loading space 10 in order from a bearing 22 side to a rotor chamber 15 side. An end portion of the bearing 22 loaded in the shaft seal device loading space 10 on a side opposite to the rotor chamber 15 is restricted by a stopper 29. The first shaft seal portion 30 and the second shaft seal portion 40 are integrally connected to each other due to the fitting structure described later so that the shaft seal device 20 is formed.

To facilitate detachable assembling of the shaft seal device 20 in the shaft seal device loading space 10, a clearance slightly larger than loose fit (JIS B 0401) is formed between the shaft seal device loading space 10 and the shaft seal device 20. When a clearance slightly larger than a loose fit is formed, shaft seal ability is sacrificed. Accordingly, an O ring 35 is disposed between an oil seal 31 and the casing 12 and an O ring 46 is disposed between a packing case 41 and the casing 12. As a matter of course, a size of the clearance is set within a range where the O rings 35, 46 can exhibit shaft seal ability. It is preferable that the O rings 35, 46 be disposed separately such that the O ring 35 is disposed in a recessed portion (annular groove) 34 of the oil seal 31 and the O ring 46 is disposed in a recessed portion (annular groove) 45 of the packing case 41. The recessed portion (annular groove) 34 of the oil seal 31 and the recessed portion (annular groove) 45 of the packing case 41 are formed on outer peripheral surfaces of the oil seal 31 and the packing case 41 along a circumferential direction respectively. Due to the provision of the O ring 35 of the oil seal 31 and the O ring 46 of the packing case 41, leakage of compressed air between the casing 12 and the first shaft seal portion 30 and leakage of compressed air between the casing 12 and the second shaft seal portion 40 can be prevented respectively.

The first shaft seal portion 30 is formed of the non-contact oil seal 31 having an oil seal portion 32. The oil seal portion 32 is, for example, the visco-seal 32 where a spiral groove is formed on an inner peripheral surface of the oil seal 31. When the rotary shaft 21 is rotated, the visco-seal 32 generates a pumping action due to viscosity of air existing between an inner peripheral surface of the visco-seal 32 and an outer peripheral surface of the rotary shaft 21. Since a lubricant is pushed toward the bearing 22 due to a pumping action of the visco-seal 32, the flowing out of the lubricant in a direction toward the rotor chamber 15 can be prevented. Although the spiral groove of the visco-seal 32 is omitted in FIGS. 2 and 3, the spiral groove is illustrated in FIG. 4. Since the spiral groove of the visco-seal 32 is formed on the inner peripheral surface of the oil seal 31, the oil seal 31 is made of a metal material which enables easy cutting of the oil seal 31.

On an end portion 36 of the oil seal 31 on a rotor chamber 15 side, a fitting projecting end portion 33 which projects toward a rotor chamber 15 side and has a cylindrical outer peripheral surface is formed. The fitting projecting end portion 33 is formed such that the fitting projecting end portion 33 is fitted in a fitting recessed end portion 44 of the packing case 41 described later by tight fit (JIS B 0401) or transition fit (JIS B 0401). The oil seal 31 and the packing case 41 are integrally connected to each other by the fitting structure. A gap between the fitting recessed end portion 44 and the fitting projecting end portion 33 is extremely small so that it is regarded that the gap does not exist in effect between the fitting recessed end portion 44 and the fitting projecting end portion 33. With such a configuration, leakage of compressed air from the gap can be prevented.

The second shaft seal portion 40 includes: a first air seal 40A disposed on a bearing 22 side; and a second air seal 40B disposed on a rotor chamber 15 side.

The first air seal 40A is formed of a packing case 41, a non-contact seal ring 42, and a resilient body 43. A projecting portion 49 which projects toward the inside in a radial direction is formed on an end portion of the packing case 41 on a rotor chamber 15 side. A cylindrical seal ring accommodating space 48 is formed between the end portion 36 of the oil seal 31 and the projecting portion 49 of the packing case 41. In the seal ring accommodating space 48, the resilient body 43, and the seal ring 42 which is supported by the resilient body 44 in such a manner that the seal ring 42 is biased in an axial direction of the rotary shaft 21 (a direction of the bearing 22 in this embodiment) are accommodated. A size of the seal ring 42 is set such that an inner diameter of the seal ring 42 is slightly larger than an outer diameter of the rotary shaft 21. The seal ring 42 is formed, for example, using a material equal to a material for forming the rotary shaft 21 (for example, stainless steel) as a base material, and a film having a small friction coefficient is applied to a surface of the base material by coating. The resilient body 43 is a metal resilient member (for example, wave spring, wave washer, a compression coil spring or the like).

The seal ring 42 resiliently supported by the resilient body 43 can move in a radial direction even when the rotary shaft 21 is deflected. A first air seal portion 61 of the second shaft seal portion 40 is formed between an inner peripheral surface of the seal ring 42 and an outer peripheral surface of the rotary shaft 21. The first air seal portion 61 has a fine gap Ga (shown in FIGS. 3 and 5). A large pressure loss is generated when compressed air passes through the fine gap Ga of the first air seal portion 61 and hence, leakage of compressed air can be suppressed.

The second air seal 40B is disposed on a rotor chamber 15 side of the first air seal 40A. The second air seal 40B is formed of a non-contact seal ring 52 and the resilient body 53. A gas seal accommodating space 58 is formed at an end portion of the shaft seal device loading space 10 in the casing 12 on a rotor chamber 15 side. The resilient body 43 and the seal ring 52 supported by the resilient body 53 in a state where the seal ring 52 is biased by the resilient body 53 in an axial direction of the rotary shaft 21 (a direction of the bearing 22 in this embodiment) are accommodated in the gas seal accommodating space 58. The gas seal accommodating space 58 has a cylindrical shape having an inner diameter size smaller than that of the first air seal 40A.

The seal ring 52 also can move in a radial direction, and a second air seal portion 62 is formed between an inner peripheral surface of the seal ring 52 and an outer peripheral surface of the rotary shaft 21. The second air seal portion 62 also has a fine gap Ga. A large pressure loss is generated when compressed air passes through the fine gap Ga of the second air seal portion 62 and hence, leakage of compressed air can be suppressed.

The second shaft seal portion 40 includes the second air seal 40B in addition to the first air seal 40A. With such a configuration, shaft seal ability of the second shaft seal portion 40 is enhanced. In the first air seal 40A and the second air seal 40B, by using the same seal ring for forming the seal rings 42, 52 and by using the same resilient body for forming the resilient bodies 43, 53, the reduction of cost can be realized.

Next, the atmosphere open passage 24 is described with reference to FIGS. 3 and 4.

In a portion of the casing 12 disposed between a position corresponding to the O ring 35 and a position corresponding to the O ring 46 and opposedly facing the oil seal 31, the atmosphere open hole 24*a* is formed. The atmosphere open hole 24*a* penetrates the casing 12, and makes the shaft seal device loading space 10 and the outside (atmosphere side) of the casing 12 communicate with each other.

On an inner peripheral side of the casing 12, an inner peripheral annular groove 24*b* which forms at least a portion of an inner peripheral annular space 24*g* is formed such that the inner peripheral annular groove 24*b* overlaps with an inner end portion of the atmosphere open hole 24*a*. The inner peripheral annular groove 24*b* is an annular groove formed on an inner peripheral surface of the casing 12 along a circumferential direction. The inner peripheral annular groove 24*b* has, for example, an approximately semicircular shape in a partial cross section taken along the axial direction of the rotary shaft 21. A tapered expanding portion 24*c* is formed on both end portions of the inner peripheral annular groove 24*b* in the axial direction of the rotary shaft 21 respectively. The respective tapered expanding portions 24*c* are formed by chamfering both end portions of the inner peripheral annular groove 24*b* in the axial direction of the rotary shaft 21 in a C-surface shape or an R-surface shape. As shown in FIG. 3, respective end portions of the respective tapered expanding portions 24*c* on a rotor chamber 15 side and a bearing 22 side project in a tapered manner. The inner peripheral annular space 24*g* on a casing 12 side is formed by the inner peripheral annular groove 24*b* and the tapered expanding portions 24*c* on a rotor chamber 15 side and a bearing 22 side. The atmosphere open hole 24*a* communicates with the inner peripheral annular space 24*g* on a casing 12 side. The atmosphere open hole 24*a* and the inner peripheral annular space 24*g* on a casing 12 side form a casing side atmosphere open passage 24*m*.

On the other hand, in the oil seal 31 of the shaft seal device 20, at least one (usually, a plurality of) communication hole (communication holes) 31*a* is/are formed in such a manner that the communication holes 31*a* penetrate the oil seal 31 in a radial direction. Although the shape of the communication hole 31*a* is not limited, for example, the communication hole 31*a* is a round hole having a circular opening cross section in a direction perpendicular to a length of the communication hole 31*a*. In a mode which does not limit the present invention, for example, four communication holes 31*a* are disposed at equal intervals in the circumferential direction at an angle of 90 degrees. An outer peripheral annular space 31*b* is formed on an outer peripheral side of the oil seal 31. The outer peripheral annular space 31*b* is an annular groove formed on an outer peripheral surface of the shaft seal device 20 along the circumferential direction such that the outer peripheral annular space 31*b* faces the inner peripheral annular groove 24*b*. Although the shape of the outer peripheral annular space 31*b* is not limited, for example, the outer peripheral annular space 31*b* has a rectangular shape in partial cross section taken along the axial direction of the rotary shaft 21. A width of an opening portion of the outer peripheral annular space 31*b* in the axial direction of the rotary shaft 21 is set equal to or larger than an opening diameter of the communication hole 31*a*.

The respective communication holes 31*a* communicate with the outer peripheral annular space 31*b* formed in the shaft seal device 20. The communication holes 31*a* and the outer peripheral annular space 31*b* form a shaft-seal-device side atmosphere open passage 31*m*. The shaft-seal-device side atmosphere open passage 31*m* communicates with the atmosphere open hole 24*a* through an inner peripheral annular space 24*g* formed in the casing 12. Accordingly, the communication holes 31*a* and the outer peripheral annular space 31*b* on a shaft seal device 20 side, and the inner peripheral annular space 24*g* and the atmosphere open hole 24*a* on a casing 12 side communicate with an atmosphere thus forming the atmosphere open passage 24. In this manner, the atmosphere open passage 24 is formed of the casing side atmosphere open passage 24*m* and the shaft-seal-device side atmosphere open passage 31*m*. In the above-mentioned configuration, the inner peripheral annular space 24*g* on a casing 12 side and the outer peripheral annular space 31*b* on a shaft seal device 20 side form a space (corresponding to "annular space" described in claims) 25 which surrounds the shaft seal device 20 in a circumferential direction.

In manufacturing the casing 12 by casting, tolerance attributed to casting is taken into consideration. In this case, as shown in FIG. 3, in the axial direction of the rotary shaft 21, a width obtained by adding a width of the inner peripheral annular groove 24*b* and widths of the tapered expanding portions 24*c* on both sides of the inner peripheral annular groove 24*b* (that is, a width of an opening portion of the inner peripheral annular space 24*g*) is set to a predetermined size slightly larger than a width of an opening portion of the outer peripheral annular space 31*b*. Even when tolerance which falls within a designed range is generated in the manufacture of the casing 12 by casting, the outer peripheral annular space 31*b* never fails to overlap with the inner peripheral annular groove 24*b* and the tapered expanding portions 24*c* on both sides of the inner peripheral annular grooves 24*b* in the axial direction of the rotary shaft 21 and hence, the deviation of the rotary shaft 21 in the axial direction can be absorbed. In the manufacture of the casing 12 by casting, a cast-in hole can be used as the atmosphere open hole 24*a*. However, the atmosphere open hole 24*a* may be formed by machining.

A ventilation gap 50 is disposed in a gap in the axial direction of the rotary shaft 21 between the visco-seal 32 of the first shaft seal portion 30 and the seal ring 42 of the second shaft seal portion 40. The ventilation gap 50 has a flow passage cross-sectional area larger than a shaft seal cross-sectional area of the air seal portion 60 in the direction orthogonal to the rotary shaft. Since the respective communication holes 31*a* communicate with the ventilation gap 50, the ventilation gap 50 communicates with the atmosphere open passage 24 opened to an atmosphere. Accordingly, the ventilation gap 50 is opened to an atmosphere through the atmosphere open passage 24.

Figure 3:
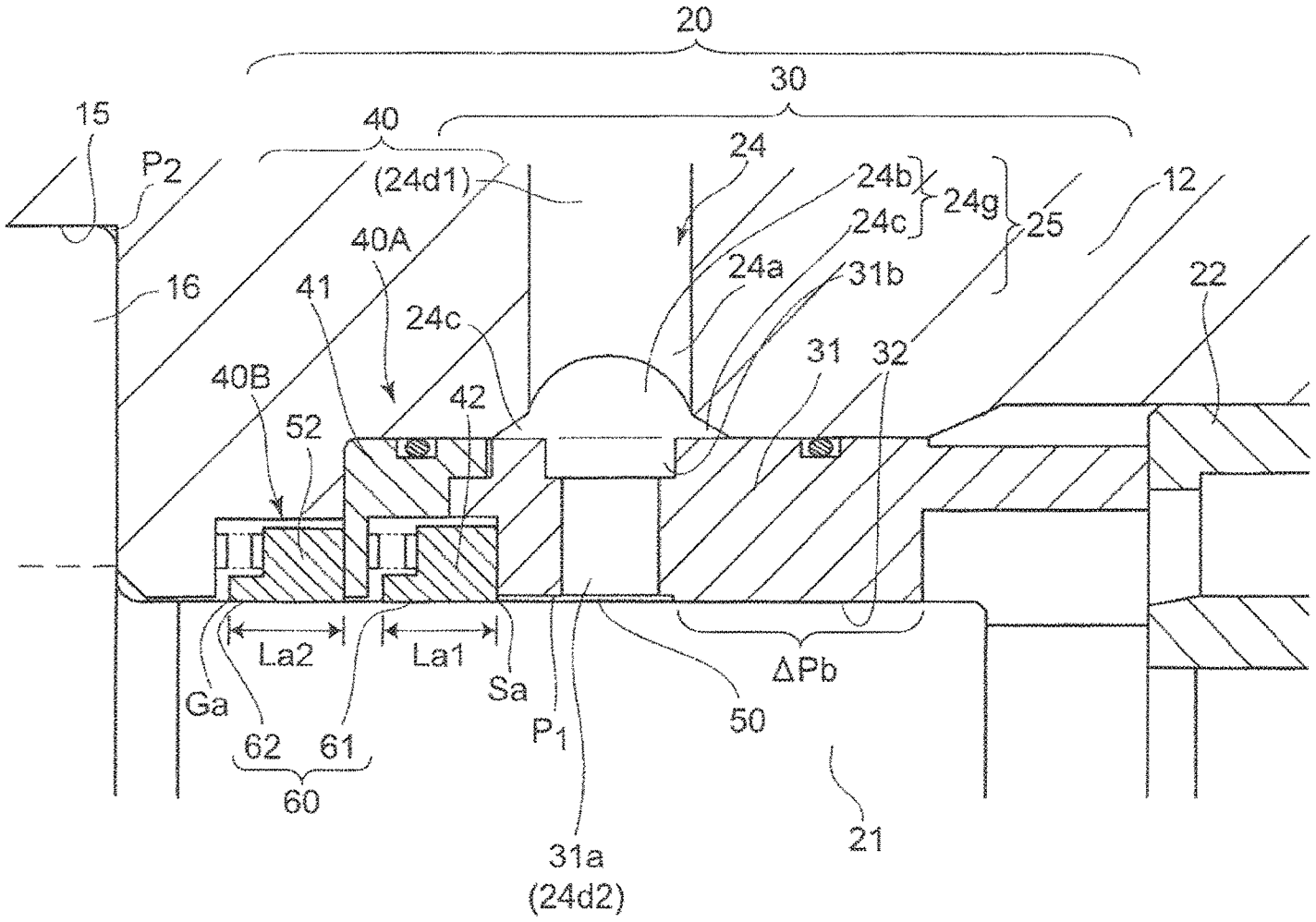
FIG. 3 is a partial cross-sectional view for describing the shaft seal device and the area around the shaft seal device shown in FIG. 2 in detail.
Figure 4:
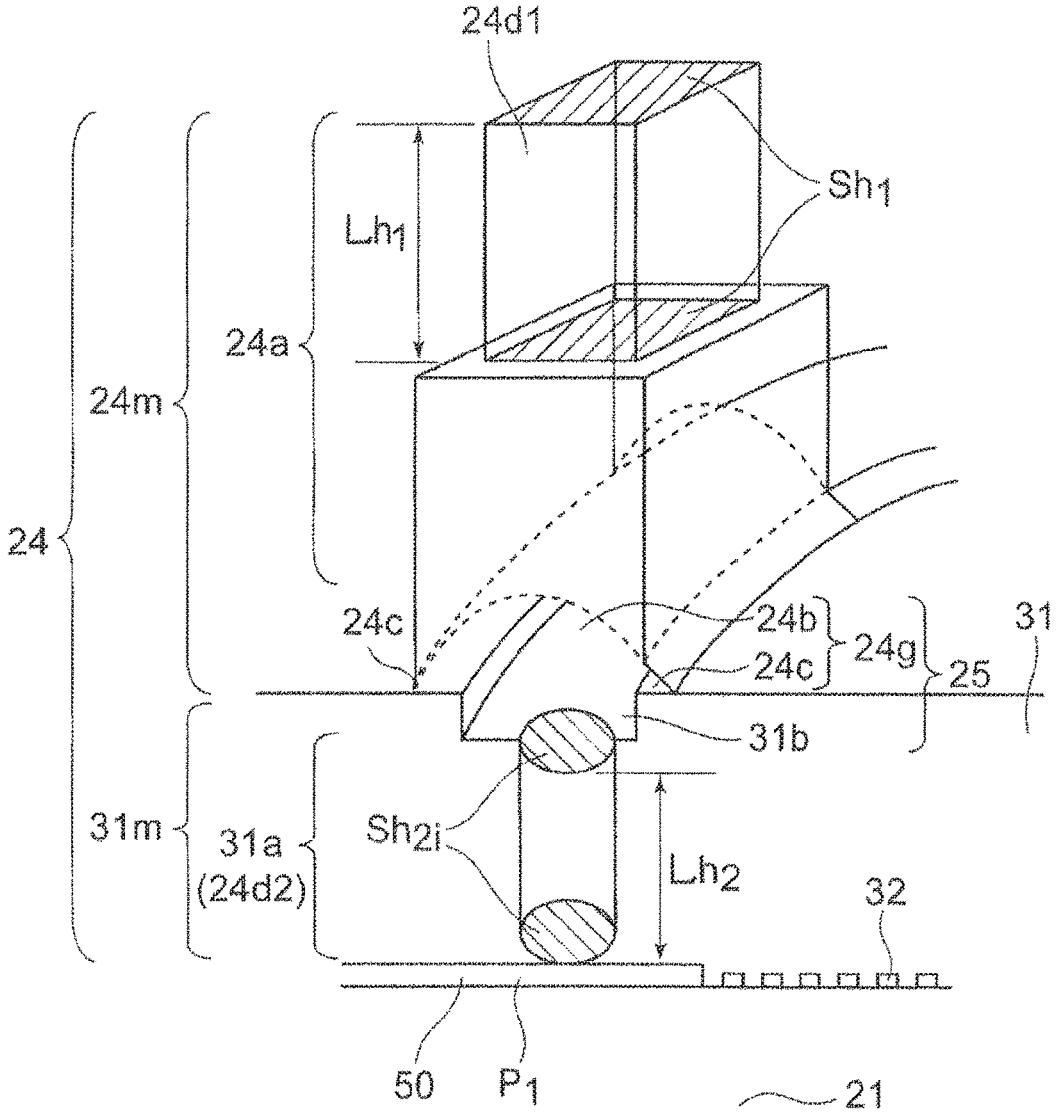
FIG. 4 is a schematic view for describing an atmosphere open passage.

As shown in FIG. 3, the air seal portion 60 is formed of: a first air seal portion 61 having a first effective shaft seal length La1; and a second air seal portion 62 having a second effective shaft seal length La2. An effective shaft seal length La of the air seal portion 60 becomes La1+La2 accordingly. As will be described later, the visco-seal 32 generates a minimum differential pressure ΔPb during an unloading operation.

During an unloading operation, the inside of the rotor chamber 15 assumes a negative pressure. The negative pressure performs an action of sucking a lubricant in the bearing 22 into the inside of the rotor chamber 15 through a gap formed between an outer peripheral surface of the rotary shaft 21 and an inner peripheral surface of the shaft seal device 20. In view of the above, the atmosphere open passage 24 which is opened to an atmosphere and the ventilation gap 50 are disposed so as to prevent a lubricant in the bearing 22 from flowing into the rotor chamber 15. However, due to a pressure loss generated in the atmosphere open passage 24 during an unloading operation, in an actual operation, a pressure in the ventilation gap 50 does not become an atmospheric pressure.

When an open cross-sectional area of the atmosphere open passage 24 is increased, the formation and the working of the atmosphere open hole 24*a* and the like become easy and a pressure loss is also decreased and hence, it is possible to make a pressure in the ventilation gap 50 approximate to an atmospheric pressure whereby it is possible to prevent a lubricant from flowing into the rotor chamber 15. Accordingly, from a viewpoint of prevention of flowing-in of a lubricant, it is preferable that an open cross-sectional area of the atmosphere open passage 24 be increased as much as possible.

On the other hand, when the open cross-sectional area of the atmosphere open passage 24 is increased, a length of the rotary shaft 21 in the axial direction is increased and hence, the rotary shaft 21 is liable to be deflected. Due to the deflection of the rotary shaft 21, shaft seal ability in the air seal portion 60 and the visco-seal 32 is lowered. Further, by taking into account the deflection of the rotary shaft 21, it is necessary to increase a gap between the female and male screw rotors 16 or a gap between the screw rotor 16 and the casing 12. However, when the gap is increased so as to prevent the contact between the members, there arises a drawback that compression performance of the oil free screw compressor 1 is adversely affected. In this manner, although there exists a trade-off relationship between the prevention of flowing-in of a lubricant and the acquisition of reliable compressibility, conventionally, no particular consideration has been made with respect to this point. The present invention provides the oil free screw compressor 1 which can acquire both the prevention of flowing-in of a lubricant and the acquisition of reliable compressibility, and a method of designing such an oil free screw compressor 1.

A method of designing the oil-free screw compressor 1 which can acquire both the prevention of flowing in of a lubricant and the acquisition of reliable compressibility is described with reference to FIGS. 3 to 6.

Assume negative pressures in the ventilation gap 50 and the rotor chamber 15 during an unloading operation (pressures expressed using an atmospheric pressure as a reference pressure (0 Pa)) as P1, P2, respectively. Assume absolute values of P1, P2 as |P1|, |P2|, respectively. Assume pressure losses generated in the air seal portion 60 and the atmosphere open passage 24 as ΔPa, ΔPh, respectively.

The following relationships are established among |P1|, |P2|, ΔPa, ΔPh.

$$|P1|=\Delta Ph$$

$$|P2|=\Delta Ph+\Delta Pa$$

To express P1 using P2, ΔPh and ΔPa, the following formula is obtained.

$$|P1|=|P2|\cdot(\Delta Ph+\Delta Pa)^{-1}\cdot\Delta Ph$$

$$\text{Because } \Delta Pa>>\Delta Ph,\ |P1|\approx|P2|\cdot(\Delta Pa)^{-1}\cdot\Delta Ph \tag{1}$$

In general, a pressure loss ΔP in an air pipe is expressed by the following formula (2).

$$\Delta P=f\cdot L\cdot d^{-1}\cdot\rho\cdot U^2 \tag{2}$$

wherein, f is pipe friction coefficient, L is pipe passage length, d is equivalent diameter, ρ is density of air, and U is a flow speed of air.

Assuming that air density U and a pipe friction coefficient f in the air seal portion 60 and air density U and a pipe friction coefficient f in the atmosphere open passage 24 are equal to each other respectively, the pressure loss ΔP is proportional to the pipe passage length L, is inversely proportional to the equivalent diameter d and is proportional to the second power of a flow speed U of air as expressed in the formula (3).

$$\Delta P\propto L\cdot d^{-1}U^2 \tag{3}$$

The flow speed U of air is inversely proportional to the second power of the equivalent diameter d, and a pipe passage cross-sectional area S is proportional to the second power of the equivalent diameter d. From these relationships, the pressure loss ΔP in the formula (3) is expressed as an approximation expressed in the formula (4).

$$\Delta P\propto L\cdot d^{-1}\cdot d^{-4}=L\cdot S^{-2.5} \tag{4}$$

From the formula (4), it is understood that the pressure loss ΔP is proportional to the pipe passage length L and is inversely proportional to $2.5^{th}$ power of the pipe passage cross-sectional area S.

To apply the relationship expressed by the formula (4) to the pressure loss ΔPa in the air seal portion 60 and the pressure loss ΔPh in the atmosphere open passage 24 respectively, the pressure losses ΔPa, ΔPh are expressed by approximations expressed in the formula (5) and the formula (6), respectively.

$$\Delta Pa\propto La\cdot Sa^{-2.5} \tag{5}$$

$$\Delta Ph\propto Lh\cdot Sh^{-2.5} \tag{6}$$

In the formula (5) and the formula (6), La indicates an effective shaft seal length in the air seal portion 60, and Lh indicates an effective narrowed length in a most narrowed portion 24*d* where a passage is made narrowest in the atmosphere open passage 24. Sa indicates a shaft seal cross-sectional area in the direction orthogonal to the rotary shaft in a fine gap Ga of the air seal portion 60, and Sh is an effective open cross-sectional area in the most narrowed portion 24*d* of the atmosphere open passage 24. The most narrowed portion 24*d* is a portion where an opening of the passage is made narrowest among portions where the opening of the passage is narrowed and portions where the opening of the passage is enlarged in the atmosphere open passage 24 so that a pressure loss in the atmosphere open passage 24 becomes maximum. The effective narrowed length and the effective open cross-sectional area in the most narrowed portion 24*d* indicate a narrowed length and an open cross-sectional area of a portion which is substantially relevant to a maximum pressure loss in the most narrowed portion 24*d*.

When a minimum differential pressure ΔPb of the oil seal portion 32 is larger than an absolute value |P1| of a negative pressure in the ventilation gap 50, air in the ventilation gap 50 is pushed out to the bearing 22 due to the minimum differential pressure ΔPb of the oil seal portion 32. Accordingly, when the following formula (7) is satisfied, flowing-in of a lubricant into the rotor chamber 15 is prevented. The minimum differential pressure ΔPb of the oil seal portion 32 indicates a minimum differential pressure among differential pressures generated in the oil seal portion 32 when all situations are taken into consideration during an unloading operation.

$$\Delta Pb>|P1| \tag{7}$$

To modify the formula (7) using the above-mentioned formula (1), formula (5) and formula (6), the following formula (8) is obtained.

$$\Delta Pb>|P2|\cdot(La\cdot Sa^{-2.5})^{-1}\cdot(Lh\cdot Sh^{-2.5}) \tag{8}$$

The following formula (9) is obtained by arranging the formula (8).

$$(La/Sa^{2.5})/(Lh/Sh^{2.5})>|P2|/\Delta Pb \tag{9}$$

When an effective shaft seal length La and a shaft seal cross-sectional area Sa of the air seal portion 60, an effective narrowed length Lh and an effective open cross-sectional area Sh of the atmosphere open passage 24, an absolute value |P2| of a negative pressure in the rotor chamber 15 and a minimum differential pressure ΔPb in the oil seal portion 32 are set so as to satisfy the formula (9), flowing-in of a lubricant into the rotor chamber 15 is prevented. Further, due to the optimization of an open cross-sectional area in the atmosphere open passage 24, it is also possible to ensure reliable compression performance. Accordingly, by forming the oil free screw compressor 1 in accordance with the formula (9), it is possible to realize both the prevention of flowing-in of a lubricant and the acquisition of reliable compressibility due to the atmosphere open passage 24.

Figure 5:
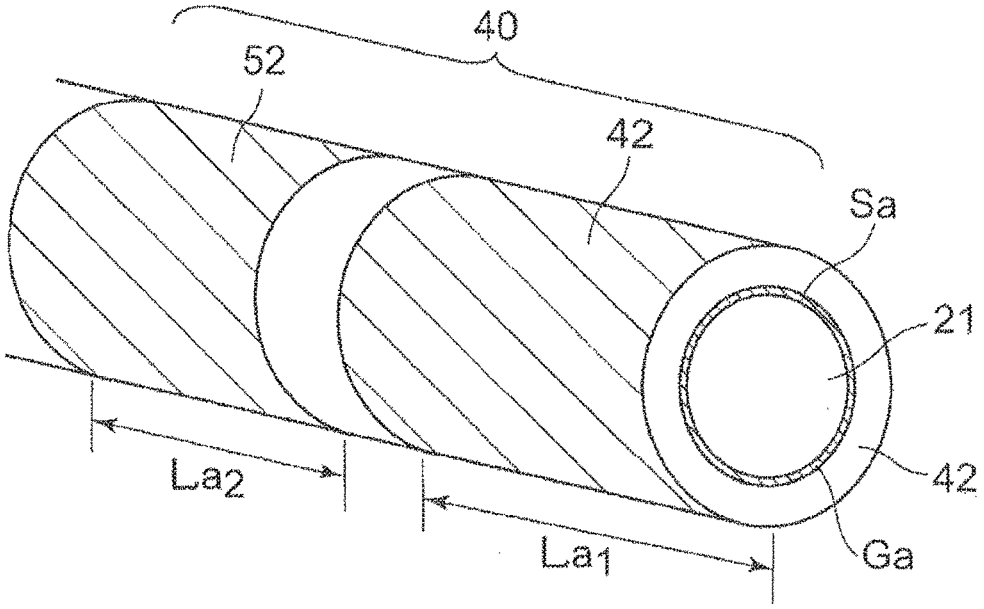
FIG. 5 is a schematic view for explaining an air seal portion.

The air seal portion 60 schematically shown in FIG. 5 is formed of: the first air seal portion 61 having a first effective shaft seal length La1; and the second air seal portion 62 having a second effective shaft seal length La2 and hence, an effective shaft seal length La of the air seal portion 60 becomes La1+La2 accordingly. A shaft seal cross-sectional area in the direction orthogonal to a rotary shaft in the fine gap Ga in the air seal portion 60 is indicated by Sa.

In the atmosphere open passage 24 schematically shown in FIG. 4, the atmosphere open hole 24*a* on a casing 12 side has an atmosphere open hole narrowed portion 24*d*1 having an open cross-sectional area Sh1. Accordingly, an effective open cross-sectional area Sh of the atmosphere open hole 24*a* on a casing 12 side becomes Sh1. Among the communication holes 31*a* on a shaft seal device 20 side, the i-th communication hole 31*a* has communication hole narrowed portions 24*d*2 each having an open cross-sectional area Sh2*i*. The communication hole 31*a* has n (n being a natural number of 1 or more) pieces of communication hole narrowed portions 24*d*2 each having an open cross-sectional area Sh2*i*, and a total open cross-sectional area Sh2 due to n pieces of communication holes 31*a* becomes Sh21+Sh22+ . . . +Sh2(*n*−1)+Sh2*n*. Accordingly, the effective open cross-sectional area Sh due to n pieces of communication holes 31*a* on a shaft seal device 20 side satisfies the following relationship.

$$Sh = Sh2 = \sum_{i=1}^{n} Sh2i$$

With respect to the atmosphere open hole narrowed portion 24*d*1 having the open cross-sectional area Sh1 and the communication hole narrowed portion 24*d*2 having the total open cross-sectional area Sh2, the narrowed portion which has the minimum effective open cross-sectional area Sh becomes the most narrowed portion 24*d* which generates a main pressure loss. That is, the effective open cross-sectional area Sh can be expressed as follows.

$$Sh = \min\left(Sh1,\ Sh2 = \sum_{i=1}^{n} Sh2i\right)$$

The cross-sectional areas of the annular flow passages of the inner peripheral annular groove 24*b* and the outer peripheral annular spaces 31*b* are formed sufficiently larger than the open cross-sectional area of the atmosphere open hole 24*a* and the total open cross-sectional area of the communication holes 31*a*, respectively, and hence, there is no possibility that the annular flow passage of the inner peripheral annular groove 24*b* and the annular flow passage of the outer peripheral annular space 31*b* become the most narrowed portion 24*d*.

When the most narrowed portion 24*d* is formed in the atmosphere open hole 24*a* of a casing-side atmosphere open passage 24*m*, the effective open cross-sectional area Sh in the atmosphere open passage 24 becomes Sh1, and the effective narrowed length Lh becomes Lh1. When the most narrowed portion 24*d* becomes the communication hole 31*a* of a shaft-seal-device side atmosphere open passage 31*m*, the effective open cross-sectional area Sh in the atmosphere open passage 24 becomes Sh2, and the effective narrowed length Lh becomes Lh2. In this manner, the effective open cross-sectional area Sh and the effective narrowed length Lh in the atmosphere open passage 24 change depending on whether the most narrowed portion 24*d* exists in the atmosphere open hole 24*a* on a casing 12 side or in the communication hole 31*a* on a shaft seal device 20 side. Accordingly, the sizes of the effective open cross-sectional area Sh and the effective narrowed length Lh can be properly set in accordance with the configuration of the atmosphere open passage 24.

Figure 6:
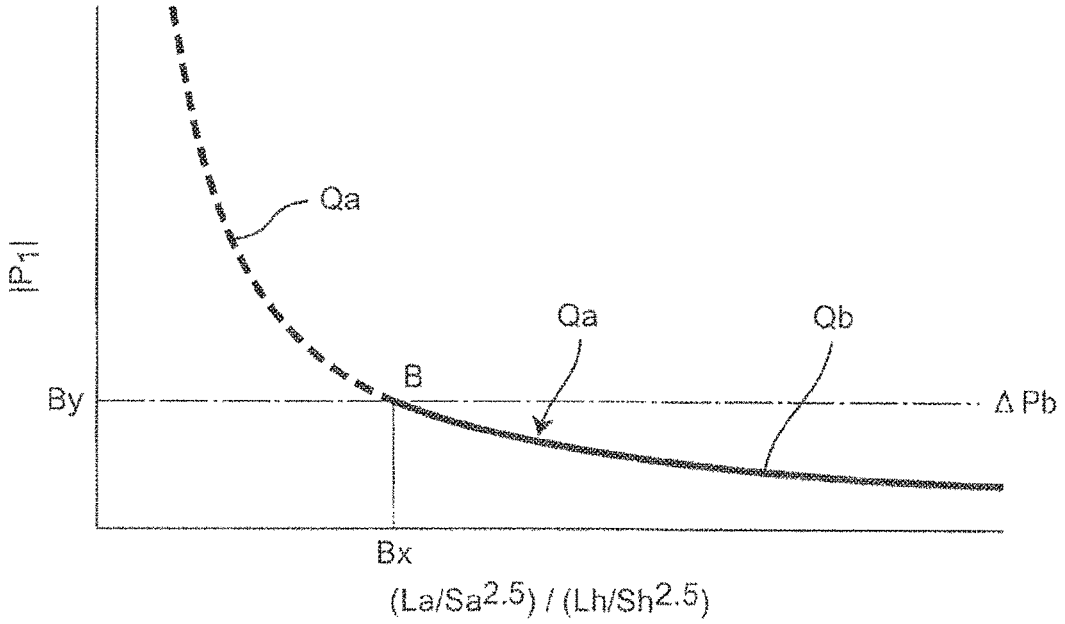
FIG. 6 is a view for schematically describing a relationship between various sizes in a portion where a pressure loss is generated, an absolute value of a negative pressure in a ventilation gap, and a minimum differential pressure in an oil seal portion.

FIG. 6 schematically shows a relationship between various sizes (La, Sa, Lh, Sh) at a portion where a pressure loss is generated, an absolute value |P1| of a negative pressure in the ventilation gap 50, and a minimum differential pressure ΔPb in the oil seal portion 32. In FIG. 6, plotting is made by taking $(La/Sa^{2.5})/(Lh/Sh^{2.5})$ on an axis of abscissas and an absolute value |P1| of a negative pressure in the ventilation gap 50 as an axis of ordinates. A design curve Q shown in FIG. 6 has a hyperbolic curve. A horizontal line indicated by a chain line which shows a minimum differential pressure ΔPb in the oil seal portion 32 intersects with the design curve Q at an intersecting point B(Bx, By).

A portion of the design curve Q where |P1| has a larger value than By is indicated by a bold dotted line Qa, and a portion of the design curve Q where |P1| has a smaller value than By is indicated by a bold solid line Qb. When |P1| has a larger value than By, an absolute value |P1| of a negative pressure in a ventilation gap 50 becomes larger than a minimum differential pressure ΔPb in the oil seal portion 32 and hence, there is a possibility that a lubricant flows in the rotor chamber 15. When |P1| has a smaller value than By, the absolute value |P1| of a negative pressure in the ventilation gap 50 becomes smaller than the minimum differential pressure ΔPb in the oil seal portion 32 and hence, flowing-in of a lubricant can be effectively prevented. Accordingly, by configuring the air seal portion 60 and the atmosphere open passage 24 such that |P1| has a smaller value than By, that is, $(La/Sa^{2.5})/(Lh/Sh^{2.5})$ has a larger value then Bx, flowing-in of a lubricant can be effectively prevented.

In the above-mentioned embodiment, the shaft seal device 20 on a discharge side has been described. However, the present invention is also applicable to the shaft seal device 20 on a suction side. The structure of the second shaft seal portion 40 in the shaft seal device 20 is not limited to the above-mentioned embodiment. The number of air seal portions and the directions of seal rings in the second shaft seal portion 40 can be changed as desired. As the second shaft seal portion 40, a known seal member such as a labyrinth seal can also be used in place of the seal ring 42, 52. As the oil seal portion 32 of the first shaft seal portion 30, the so-called visco-seal 32 is exemplified. However, a known seal structure such as a labyrinth seal can also be used.

In the above-mentioned embodiment, the oil seal 31 and the packing case 41 are respectively formed of a unitary member. However, provided that the oil seal 31 and the packing case 41 have the integral configuration at the time of assembling the oil seal 31 and the packing case 41, the oil seal 31 and the packing case 41 may be respectively formed of two or more members split in the axial direction of the rotary shaft 21. The oil seal 31 may be formed of an oil seal portion 32 and a body portion which supports the oil seal portion 32 thereon. A surface of the rotary shaft 21 may be formed of a base material of the rotary shaft 21 per se or may be formed of any one of various films applied to a surface of the base material. The mode of the rotary shaft 21 according to the present invention includes a mode where the rotary shaft 21 is used in a single form or a mode where a sleeve not shown in the drawing is fixed to an outer peripheral surface side of the rotary shaft 21.

In the above-mentioned embodiment, the annular space 25 is formed by both the inner peripheral annular space 24*g* on a casing 12 side and the outer peripheral annular space 31*b* on a shaft seal device 20 side. However, the annular space 25 may be formed by either one of the inner peripheral annular space 24*g* or the outer peripheral annular space 31*b*.

As described above, to exemplify the technical feature of this disclosure as an example, the above-mentioned embodiment has been described, and the accompanying drawings and the detailed description are provided for describing the embodiment.

Therefore, the constitutional elements described in the accompanying drawings and the detailed description include not only constitutional elements which are indispensable for solving the problems of the present invention but also constitutional elements which are not indispensable for solving the problems of the present invention and are provided for exemplifying the above-mentioned technique. Accordingly, it should not be construed that the fact that constitutional elements which are not indispensable for solving the problems of the present invention are described in accompanying drawings and the detailed description readily verifies that the constitutional elements which are not indispensable for solving the problems of the present invention are also included in the constitutional elements which are indispensable for solving the problems of the present invention.

Although this disclosure has been sufficiently described in conjunction with the preferred embodiment with reference to accompanying drawings, it is apparent for those who are skilled in the art that various modifications and variations can be made based on this disclosure. It should be construed that such modifications and variations are also embraced by the present invention so long as such modifications and variations fall within the scope of the invention called for in claims.

As can be clearly understood from the description made heretofore, in the oil-free screw compressor 1 according to the present invention, an approximation relating to a pressure loss in an air pipe is applied to the most narrowed portion 24*d* and the air seal portion 60 of the atmosphere open passage 24, and the oil-free screw compressor is configured such that the minimum differential pressure ΔPb in the oil seal portion 32 becomes larger than the absolute value |P1| of a negative pressure in the ventilation gap 50. With such a configuration, air in the ventilation gap 50 is intended to be pushed out toward the bearing 22 and hence, the flowing in of a lubricant into the rotor chamber 15 can be prevented. Compression performance can be reliably realized through the optimization of the open cross-sectional area of the atmosphere open passage 24. Accordingly, the oil-free screw compressor 1 can realize both the prevention of flowing in of a lubricant and the acquisition of reliable compressibility.

The present invention has the following technical feature in addition to the above-mentioned technical feature.

That is, the atmosphere open passage 24 has the atmosphere open hole 24*a* formed in the casing 12, and at least one communication hole 31*a* formed in the shaft seal device 20, and the annular space 25 which surrounds the shaft seal device 20 in a circumferential direction is formed by both of or either one of the inner peripheral side of the casing and the outer peripheral side of the shaft seal device, and the atmosphere open hole 24*a* and at least one of the communication holes 31*a* communicate with each other through the annular space 25, and the most narrowed portion 24*d* is the smaller one between the open cross-sectional area Sh1 of the atmosphere open hole 24*a* and the total open cross-sectional area Sh2 of at least one communication hole 31*a*. With such a configuration, the effective open cross-sectional area Sh and the effective narrowed length Lh in the atmosphere open passage 24 change depending on whether the most narrowed portion 24*d* exists in the atmosphere open hole 24*a* on a casing 12 side or in the communication hole 31*a* on a shaft seal device 20 side. Accordingly, the effective open cross-sectional area Sh and the effective narrowed length Lh can be properly set in accordance with the configuration of the atmosphere open passage 24.

The oil seal portion 32 is formed of the visco-seal. With such a configuration, it is possible to prevent a lubricant from flowing into the rotor chamber 15 by a spiral groove formed on the visco-seal 32.

The invention claimed is:

1. An oil-free screw compressor comprising:

a pair of female and male screw rotors which meshes with each other in a non-contact manner;

a casing having a rotor chamber in which the screw rotors are housed;

a bearing which supports rotary shafts of the screw rotors;

a shaft seal device which includes an oil seal portion disposed on a bearing side and an air seal portion disposed on a rotor chamber side and shaft-seals the rotary shaft;

a ventilation gap which is positioned between the oil seal portion and the air seal portion and is formed between an outer peripheral surface of the rotary shaft and an inner peripheral surface of the shaft seal device; and an atmosphere open passage which makes an atmosphere side of the casing and the ventilation gap communicate with each other, wherein a most narrowed portion of the atmosphere open passage, the air seal portion and the oil seal portion are set such that a following relationship is established:

$$(La/Sa^{2.5})/(Lh/Sh^{2.5})>|P2|/\Delta Pb$$

wherein an effective open cross-sectional area as Sh and an effective narrowed length as Lh in the most narrowed portion;

a shaft seal cross-sectional area in a direction orthogonal to a rotary shaft as Sa and an effective shaft seal length as La in a fine gap in the air seal portioned;

an absolute value of a negative pressure in the rotor chamber during an unloading operation as |P2|;

a minimum differential pressure in the oil seal portion during the unloading operation as ΔPb;

wherein the atmosphere open passage has an atmosphere open hole formed in the casing, and at least one communication hole formed in the shaft seal device, and an annular space which surrounds the shaft seal device in a circumferential direction is formed by both of or either one of an inner peripheral side of the casing and an outer peripheral side of the shaft seal device, and the atmosphere open hole and at least one of the communication holes communicate with each other through the annular space, and the most narrowed portion of the atmosphere open passage is smaller one between an open cross-sectional area of the atmosphere open hole and a total open cross-sectional area of the at least one communication hole.

2. The oil-free screw compressor according to claim 1, wherein the oil seal portion is a visco-seal.

3. The oil-free screw compressor according to claim 1, wherein the oil seal portion is a visco-seal.

4. The oil-free screw compressor according to claim 1, wherein the dimension of the ventilation gap in the orthogonal direction of the rotary shaft is significantly smaller than the dimension of the communication hole in the orthogonal direction of the rotary shaft.

5. The oil-free screw compressor according to claim 4, wherein the outer peripheral surface of the rotary shaft has a constant diameter at least in a range between the oil seal portion and the air seal portion along a longitudinal direction of the rotary shaft.

6. A method of designing an oil-free screw compressor comprising:

a pair of female and male screw rotors which meshes with each other in a non-contact manner;

a casing having a rotor chamber in which the screw rotors are housed;

a bearing which supports rotary shafts of the screw rotors;

a shaft seal device which includes an oil seal portion disposed on a bearing side and an air seal portion disposed on a rotor chamber side and shaft-seals the rotary shaft;

a ventilation gap which is positioned between the oil seal portion and the air seal portion and is formed between an outer peripheral surface of the rotary shaft and an inner peripheral surface of the shaft seal device; and an atmosphere open passage which makes an atmosphere side of the casing and the ventilation gap communicate with each other, wherein a most narrowed portion of the atmosphere open passage, the air seal portion and the oil seal portion are set such that a following relationship is established $$(La/Sa^{2.5})/(Lh/Sh^{2.5})>|P2|/\Delta Pb$$

wherein an effective open cross-sectional area as Sh and an effective narrowed length as Lh in the most narrowed portion where the atmosphere open passage is most narrowed;

a shaft seal cross-sectional area in a direction orthogonal to a rotary shaft as Sa and an effective shaft seal length as La in a fine gap in the air seal portioned;

an absolute value of a negative pressure in the rotor chamber during an unloading operation as |P2|;

a minimum differential pressure in the oil seal portion during the unloading operation as ΔPb;

wherein the atmosphere open passage has an atmosphere open hole formed in the casing, and at least one communication hole formed in the shaft seal device, and an annular space which surrounds the shaft seal device in a circumferential direction is formed by both of or either one of an inner peripheral side of the casing and an outer peripheral side of the shaft seal device, and the atmosphere open hole and at least one of the communication holes communicate with each other through the annular space, and the most narrowed portion of the atmosphere open passage is smaller one between an open cross-sectional area of the atmosphere open hole and a total open cross-sectional area of the at least one communication hole.

7. The method of designing an oil-free screw compressor according to claim 6, wherein the oil seal portion is a visco-seal.

8. The method of designing an oil-free screw compressor according to claim 6, wherein the oil seal portion is a visco-seal.

* * * * *